US005413904A

United States Patent [19]

Chang et al.

[11] Patent Number: 5,413,904

[45] Date of Patent: May 9, 1995

[54] HIGH CHLORIDE [100] TABULAR GRAIN EMULSIONS IMPROVED EMULSIONS AND IMPROVED PRECIPITATION PROCESSES

[75] Inventors: Yun C. Chang, Rochester; Pierre-Henri Jezequel, Pittsford, both of N.Y.

[73] Assignee: Eastman Kodak Company, Rochester, N.Y.

[21] Appl. No.: 253,532

[22] Filed: Jun. 3, 1994

Related U.S. Application Data

[63] Continuation-in-part of Ser. No. 215,072, Mar. 18, 1994, abandoned.

[51] Int. Cl.[6] ..... G03C 1/015

[52] U.S. Cl. ..... 430/569; 430/567

[58] Field of Search ..... 430/567, 569

[56] References Cited

U.S. PATENT DOCUMENTS

| | | | |
|---|---|---|---|
| 5,264,337 | 11/1993 | Maskasky | 430/567 |
| 5,292,632 | 3/1994 | Maskasky | 430/567 |
| 5,314,798 | 5/1994 | Brust et al. | 430/569 |
| 5,320,938 | 6/1994 | House et al. | 430/567 |

*Primary Examiner*—Janet C. Baxter
*Assistant Examiner*—Mark F. Huff
*Attorney, Agent, or Firm*—Carl O. Thomas

[57] ABSTRACT

An improved preparation of high chloride {100} tabular grain emulsions that relies on iodide ions to produce tabular grain growth is disclosed. By delaying iodide ion introduction until after the initiation of grain nucleation the proportion of total grain projected area accounted for by high chloride {100} tabular grains is increased. The projected areas of the {100} tabular grains can exceed 95 percent of total grain projected area.

3 Claims, 2 Drawing Sheets

10μm

10 μm

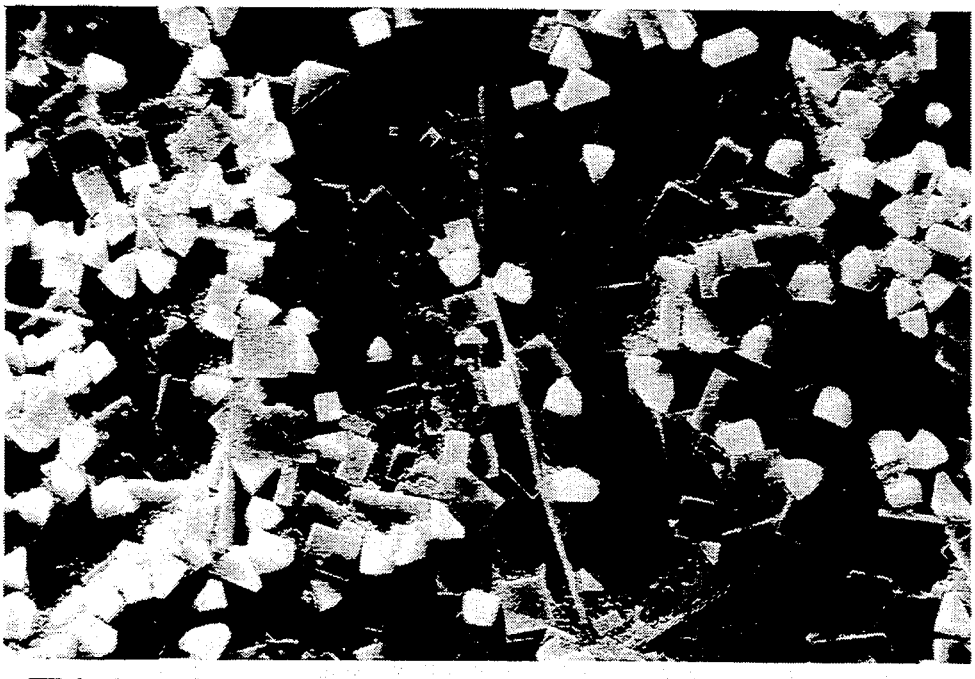
FIG. 2 (CONTROL) 10 μm
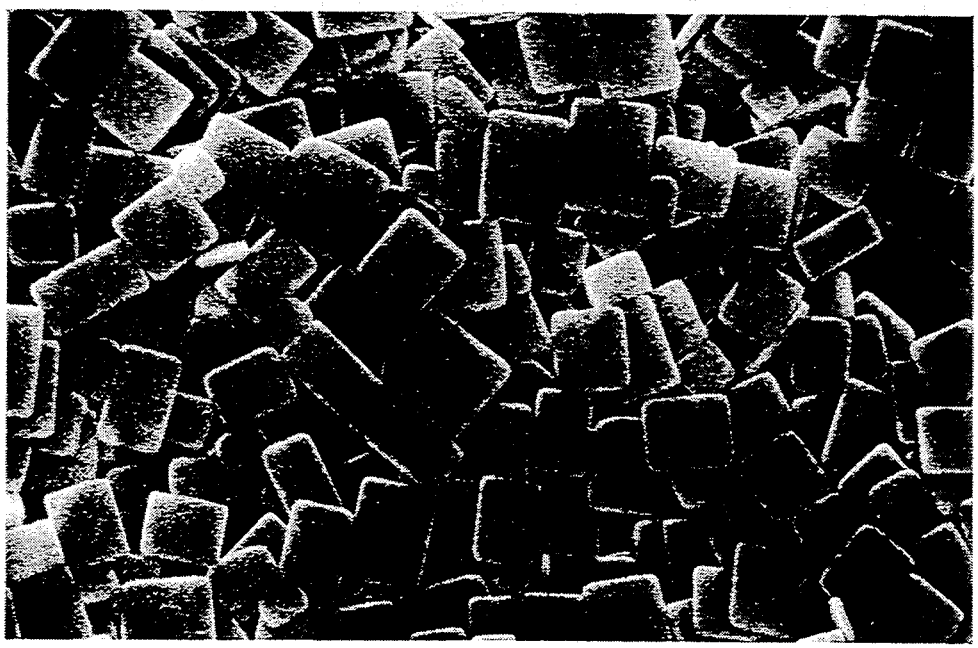
FIG. 3 10 μm

HIGH CHLORIDE [100] TABULAR GRAIN EMULSIONS IMPROVED EMULSIONS AND IMPROVED PRECIPITATION PROCESSES

This is a continuation-in-part of U.S. Ser. No. 08/215,072, filed Mar. 18, 1994, now abandoned.

FIELD OF THE INVENTION

The invention pertains to photographic emulsions and to processes for their preparation.

BACKGROUND OF THE INVENTION

Maskasky U.S. Pat. No. 5,292,632, titled HIGH TABULARITY HIGH CHLORIDE EMULSIONS WITH INHERENTLY STABLE GRAIN FACES, and Maskasky U.S. Pat. No. 5,264,337, titled MODERATE ASPECT RATIO TABULAR GRAIN HIGH CHLORIDE EMULSIONS WITH INHERENTLY TABLE GRAIN FACES, each commonly assigned, each disclose the preparation of high chloride tabular grain emulsions in which the tabular grains have {100} major faces, hereinafter referred to as high chloride {100} tabular grain emulsions. Unless otherwise qualified subsequent references to "Maskasky" refer to these two filings as collective entity. The technique which Maskasky employs to cause tabular grains to form is to employ during grain nucleation and growth a restraining agent to prevent the emergence of non-{100} grain faces. The restraining agents disclosed are each organic compounds containing a nitrogen atom with a resonance stabilized $\pi$ electron pair. The trivalent nitrogen atom is either directly bonded to an aromatic ring, as illustrated by aniline, or present in the ring, as illustrated by indole, pyridine and 1,3,5-triazine.

Although Maskasky was able to produce high chloride {100} tabular grain emulsions, the requirement of an organic restraining agent adsorbed to the faces of the tabular grains is a disadvantage. Many components of photographic emulsions, such as spectral sensitizing dyes, antifoggants and stabilizers, latent image keeping addenda and nucleating agents require adsorption to grain surfaces to be effective. To the extent that these photographically useful addenda must compete with the restraining agent for grain surface access the photographic effectiveness of the emulsions are diminished.

House et al U.S. Pat. No. 5,320,938, titled HIGH CHLORIDE TABULAR GRAIN EMULSIONS AND PROCESSES FOR THEIR PREPARATION, commonly assigned, discloses a process for the preparation of high chloride {100} tabular grain emulsions that runs contrary to the teachings of Maskasky and other, earlier high chloride tabular grain emulsion preparation teachings. Instead of employing an adsorbed organic restraining agent to cause the tabular grains to form House et al relies upon the presence of iodide ion at the grain nucleation site to form improved high chloride {100} tabular grain emulsions.

Maskasky U.S. Pat. No. 5,292,632 requires at least 30 percent of total grain projected area to be accounted for by high chloride {100} tabular grains, while many of the Examples produce emulsions in which the tabular grains account for less than 50 percent of total grain projected area. Maskasky U.S. Pat. No. 5,264,337 and House et al require the high chloride {100} tabular grains to account for at least 50 percent of total grain projected area, while many of the Examples produce emulsions in which the tabular grains account for less than 80 percent of total grain projected area. Maskasky and House et al each disclose that the high chloride {100} tabular grains can account for greater than 90 percent of total grain projected area, but no actual measurement of a projected area in excess of 90 percent is provided. House et al reports two different emulsions in which high chloride {100} tabular grains account for nominally greater than 90 percent tabular grains; however, review of these precipitations shows that in no instance did the nominally "greater than 90 percent projected area" approach a projected area of 95 percent. In fact, each of the emulsions of Maskasky and House et al contain appreciable inclusions of unwanted grain populations in addition to the high chloride {100} tabular grains sought.

Brust et al U.S. Pat. No. 5,314,798, titled IODIDE BANDED TABULAR GRAIN EMULSIONS, commonly assigned, initiating high chloride {100} tabular grain growth by the procedures taught by Maskasky or House et al, followed by the introduction of a higher iodide band, preferably in the latter stages of precipitation. The higher iodide band improves the speed-granularity of the emulsion, but has little, if any, influence on the percentage of total grain projected area accounted for by tabular grains.

SUMMARY OF THE INVENTION

The present invention represents an improvement on the teachings of House et al. The improvement resulted from an interest in reducing to an insignificant level the population of grains other than high chloride {100} tabular grains in the emulsions of House et al and from an interest in arriving at an emulsion preparation approach that would be highly robust—that is, that would continue to provide optimum or near optimum grain characteristics with minimal adjustments when the scale and equipment of precipitation was varied.

As repeated efforts to identify a robust optimization of the House et al precipitation techniques proceeded, it became apparent that the presence of iodide during grain nucleation, though providing a clear advantage over the precipitation methods of Maskasky, was nevertheless a major source of unwanted grain populations. Specifically, it was discovered that the presence of iodide ion at the outset of grain nucleation is responsible for producing unwanted grains, principally singly twinned nontabular grains.

The present invention is based on the discovery that both the precipitation process and the emulsions that are produced by the precipitation process can be improved by delaying the introduction of iodide ion into the dispersing medium until after the onset of grain nucleation.

In one aspect the invention is directed to a process of precipitating a photographic emulsion containing grains comprised of iodide and at least 50 mole percent chloride with tabular grains having {100} major faces accounting for greater than 50 percent of total grain projected area, comprised of the steps of (1) separately introducing soluble silver and halide salts into a reaction vessel containing at least a portion of the dispersing medium so that nucleation occurs while the dispersing medium is maintained at a pCl in the range of from 0.5 to 3.5 and (2) following step (1) completing grain growth under conditions that maintain the {100} major faces of the tabular grains, wherein, (3) precipitation is conducted in the absence of an aromatic grain growth stabilizer containing a nitrogen atom having a resonance stabilized $\pi$ electron pair and (4) during step (1) iodide ion is withheld from the reaction vessel until after the soluble silver and halide salts have reacted in the reaction vessel to form grain nuclei and thereafter introduced into the reaction vessel.

In another aspect this invention is directed to a radiation sensitive emulsion containing a silver halide grain population comprised of iodide and at least 50 mole percent chloride, wherein tabular grains having {100} major faces and an aspect ratio of at least 2 account for greater than 95 percent of total grain projected area.

BRIEF DESCRIPTION OF THE DRAWINGS

FIGS. 1 and 3 are scanning electron micrographs of novel emulsions satisfying the requirements of the invention and FIG. 2 is a scanning electron micrograph of a comparative emulsion.

DESCRIPTION OF PREFERRED EMBODIMENTS

Figure 1:
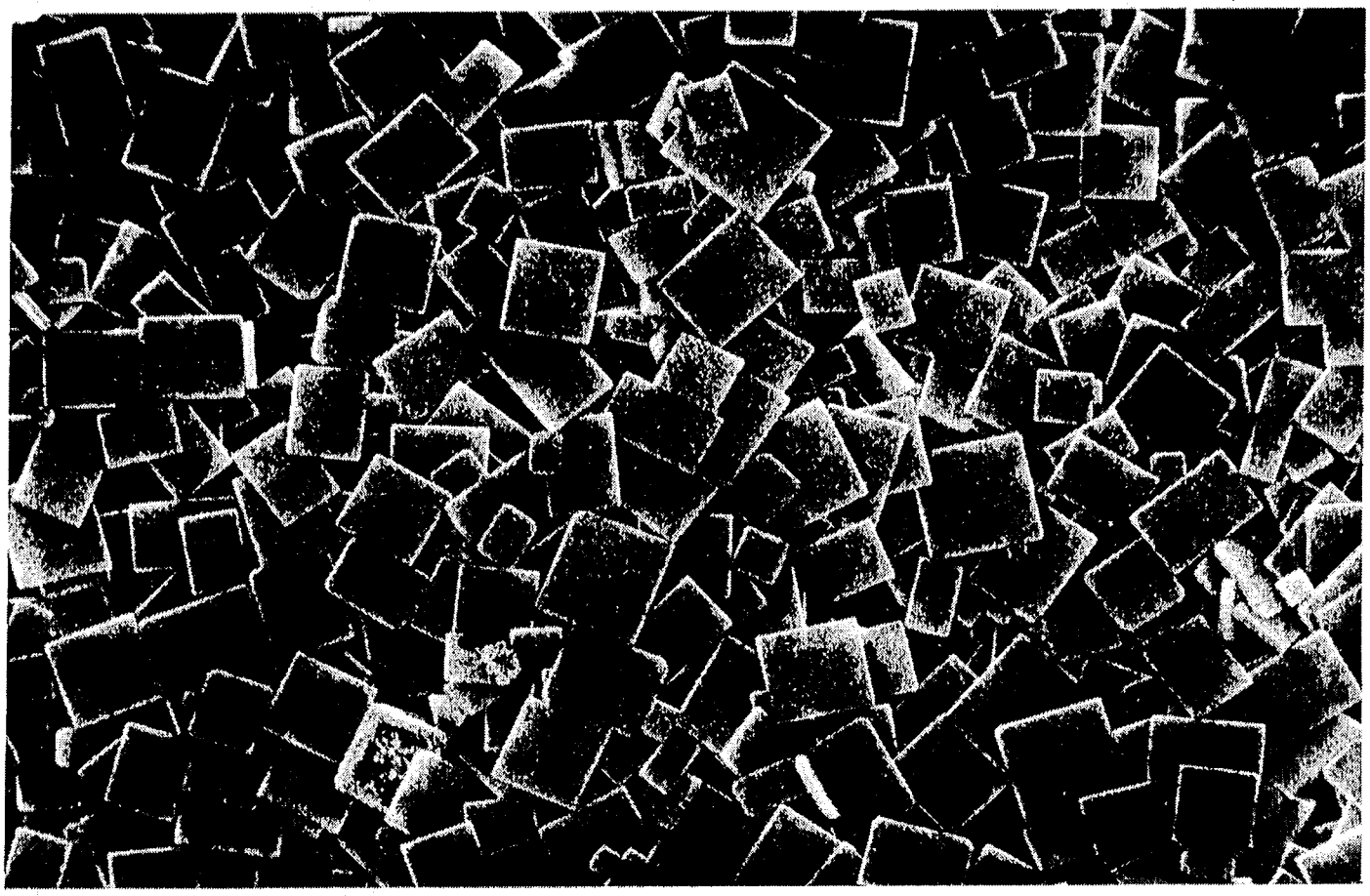

As employed herein the term "high chloride {100} tabular grain" indicates a grain that contains at least 50 mole percent chloride, based on silver, that exhibits major faces lying in {100} crystal planes, exhibits an aspect ratio of at least 2 and a ratio of major face adjacent edge lengths of less than 10.

A "high chloride {100} tabular grain emulsion" is an emulsion in which greater than 50 percent of total grain projected area is accounted for by high chloride {100} tabular grains.

Aspect ratio is defined as ECD/t, where ECD is the equivalent circular diameter of a grain and t is its thickness. Average aspect ratio is the quotient average ECD and average grain thickness.

The term "oxidized gelatin" refers to gelatin that has been treated with an oxidizing agent to reduce methionine to less than 12 micromoles per gram.

The present invention is an improvement on the high chloride {100} tabular grain precipitation process disclosed by House et al, cited above and here incorporated by reference. Except as otherwise described the precipitation procedures and emulsions satisfying the requirements of this invention can take any of the forms described by House et al, the disclosure of which is here incorporated by reference.

Grain nucleation is undertaken by separately introducing soluble silver and halide salts into a reaction vessel containing at least a portion of the dispersing medium forming the final emulsion while the dispersing medium is maintained at a pCl in the range of from 0.5 to 3.5. Following grain nucleation grain growth is completed under conditions that maintain the {100} major faces of the tabular grains.

Unlike Maskasky precipitation is conducted in the absence of an aromatic grain growth stabilizer containing a nitrogen atom having a resonance stabilized $\pi$ electron pair.

Unlike House et al iodide ion is withheld from the reaction vessel until after grain nucleation has been initiated, but then introduced before 40 percent of the silver halide been introduced.

The inclusion of iodide into the cubic crystal lattice being formed by silver ions and the remaining halide ions is disruptive because of the much larger diameter of iodide ion as compared to chloride ion. The incorporated iodide ions introduce crystal irregularities. The present invention differs from House et al in withholding iodide ion until after grain nuclei formation has been initiated in the high chloride environment. This avoids the formation of unwanted grain shapes, such as singly twinned nontabular grains. After grain nuclei have been formed under conditions that favor the formation of cubic grains, the delayed introduction of iodide ion along with the silver and halide ions required for further grain growth results in the pre-existing grain nuclei growing into tabular grains rather than regular (cubic) grains.

It is believed that the delayed incorporation of iodide ion into the crystal structure of preexisting cubic grain nuclei results in more growth accelerating irregularities in at least two adjacent cubic crystal faces. Unlike the emulsions of House et al, which contained a significant rod population, indicative of growth accelerating crystal face irregularities in only one or perhaps two opposed cubic crystal faces, the precipitation process of the present invention has been observed to produce emulsions nearly devoid of rods. This suggests that the delayed introduction of iodide ions is even more effective than having iodide ions present at the outset of the nucleation, as taught by House et al.

At the outset of precipitation a reaction vessel is provided containing a dispersing medium and conventional silver and reference electrodes for monitoring halide ion concentrations within the dispersing medium. Halide ion is introduced into the dispersing medium that is at least 50 mole percent chloride—i.e., at least half by number of the halide ions in the dispersing medium are chloride ions. The pCl of the dispersing medium is adjusted to favor the formation of {100} grain faces on nucleation—that is, within the range of from 0.5 to 3.5, preferably within the range of from 1.0 to 3.0 and, optimally, within the range of from 1.5 to 2.5.

The grain nucleation step is initiated when a silver jet is opened to introduce silver ion into the dispersing medium. Iodide ion is withheld from the dispersing medium until after the onset of grain nucleation. Preferably iodide ion introduction is delayed until at least 0.005 percent of total silver used to form the emulsion has been introduced into the dispersing medium. Preferred results (high chloride {100} tabular grain projected areas of greater than 95 percent in the completed emulsions) are realized when iodide ion introduction is initiated in the period ranging from 0.01 to 3 (optimally 1.5) percent of total silver is introduction.

Effective tabular grain formation can occur over a wide range of iodide ion concentrations ranging up to the saturation limit of iodide in silver chloride. The saturation limit of iodide in silver chloride is reported by H. Hirsch, "Photographic Emulsion Grains with Cores: Part I. Evidence for the Presence of Cores", J. of Photog. Science, Vol. 10 (1962), pp. 129–134, to be 13 mole percent. In silver halide grains in which equal molar proportions of chloride and bromide ion are present up to 27 mole percent iodide, based on silver, can be incorporated in the grains. It is contemplated to undertake grain growth below the iodide saturation limit to avoid the precipitation of a separate silver iodide phase and thereby avoid creating an additional category of unwanted grains. It is generally preferred to maintain the iodide ion concentration after its delayed introduction into the dispersing medium at the outset of nucleation at less than 10 mole percent. In fact, only minute amounts of iodide are required to achieve the desired tabular grain population. Concentrations of iodide after its delayed introduction down to 0.001 mole percent, based on total silver, are contemplated. For convenience in replication of results, it is preferred to maintain the concentrations iodide ion after its delayed introduction in the range of at least 0.005 mole percent and, optimally, at least 0.07 mole percent, based on total silver. The preferred delays of iodide ion introduction noted above are effective with minimum and near minimum iodide introduction levels. However, with further delays in iodide introduction that can range up to 40 percent or more of total silver introduction, compensating increases in iodide concentrations are contemplated.

In a preferred method silver chloride grain nuclei are formed at the outset of the nucleation step. Minor amounts of bromide ion can be present also in the dispersing medium at the outset of nucleation. Any amount of bromide ion can be present in the dispersing medium at the outset of nucleation and subsequently that is compatible with at least 50 mole percent of the halide in the grain nuclei being chloride ions. The grain nuclei preferably contain at least 70 mole percent and optimally at least 90 mole percent chloride ion, based on silver.

Grain nuclei formation occurs instantaneously upon introducing silver ion into the dispersing medium. Precipitation under the initial conditions in the reaction vessel, hereinafter referred to as Step (1) conditions, can be terminated at any time after the minimum iodide addition described above has been completed. Since silver iodide is much less soluble than silver chloride, any iodide ion introduced into the dispersing medium precipitates instantaneously. For manipulative convenience and reproducibility, silver ion introduction under Step (1) conditions is preferably extended for a convenient period, typically from 5 seconds to less than 2 minutes, and typically during this period from about 0.1 to 10 mole percent of total silver is introduced into the dispersing medium. So long as the pCl remains within the ranges set forth previously no additional chloride ion need be added to the dispersing medium during Step (1). It is, however, preferred to introduce both silver and halide salts concurrently during this step. The advantage of adding halide salts concurrently with silver salt throughout Step (1) is that the variation of pCl within the dispersing medium can be minimized or eliminated. Once sufficient iodide introduction has occurred to initiate tabular grain growth, further iodide introduction is not required to sustain tabular grain growth. Thus, subsequent iodide introduction in either or both of Step (1) or the subsequent growth step, hereinafter designated Step (2), is a matter of preference only based on well known photographic performance considerations.

Any convenient conventional choice of soluble silver and halide salts can be employed during the Step (1). Silver ion is preferably introduced as an aqueous silver salt solution, such as a silver nitrate solution. Halide ion is preferably introduced as alkali or alkaline earth halide, such as lithium, sodium, potassium and/or calcium chloride, bromide and/or iodide.

The dispersing medium contained in the reaction vessel prior to nucleation is comprised of water, the dissolved halide ions discussed previously and a peptizer. The dispersing medium can exhibit a pH within any convenient conventional range for silver halide precipitation, typically from 2 to 8. It is preferred, but not required, to maintain the pH of the dispersing medium on the acid side of neutrality (i.e., $<7.0$). To minimize fog a preferred pH range for precipitation is from 2.0 to 6.0. Mineral acids, such as nitric acid or hydrochloride acid, and bases, such as alkali hydroxides, can be used to adjust the pH of the dispersing medium. It is also possible to incorporate pH buffers.

The peptizer can take any convenient conventional form known to be useful in the precipitation of photographic silver halide emulsions and particularly tabular grain silver halide emulsions. A summary of conventional peptizers is provided in *Research Disclosure,* Vol. 308, December 1989, Item 308119, Section IX. *Research Disclosure* is published by Kenneth Mason Publications, Ltd., Emsworth, Hampshire PO10 7DD, England. It is preferred to employ gelatino peptizers (e.g., gelatin and gelatin derivatives). As manufactured and employed in photography gelatino peptizers typically contain significant concentrations of calcium ion, although the use of deionized gelatino peptizers is a known practice. In the latter instance it is preferred to compensate for calcium ion removal by adding divalent or trivalent metal ions, such alkaline earth or earth metal ions, preferably magnesium, calcium, barium or aluminum ions. Specifically preferred peptizers are low methionine gelatino peptizers (i.e., those containing less than 30 micromoles of methionine per gram of peptizer), optimally less than 12 micromoles of methionine per gram of peptizer, these peptizers and their preparation are described by Maskasky U.S. Pat. No. 4,713,323 and King et al U.S. Pat. No. 4,942,120, the disclosures of which are here incorporated by reference. However, it should be noted that the grain growth modifiers of the type taught for inclusion in the emulsions of Maskasky U.S. Pat. Nos. 4,400,463 and 4,713,323 (e.g., adenine) are not appropriate for inclusion in the dispersing media used in the method described herein, since these grain growth modifiers promote twinning and the formation of tabular grains having {111} major faces. Generally at least about 10 percent and typically from 20 to 80 percent of the dispersing medium forming the completed emulsion is present in the reaction vessel at the outset of the nucleation step. It is conventional practice to maintain relatively low levels of peptizer, typically from 10 to 20 percent of the peptizer present in the completed emulsion, in the reaction vessel at the start of precipitation. To increase the proportion of thin tabular grains having {100} faces formed during nucleation it is preferred that the concentration of the peptizer in the dispersing medium be in the range of from 0.5 to 6 percent by weight of the total weight of the dispersing medium at the outset of the nucleation step. It is conventional practice to add gelatin, gelatin derivatives and other vehicles and vehicle extenders to prepare emulsions for coating after precipitation. Any naturally occurring level of methionine can be present in gelatin and gelatin derivatives added after precipitation is complete.

Step (1) can be performed at any convenient conventional temperature for the precipitation of silver halide emulsions. Temperatures ranging from near ambient—e.g., 30° C. up to about 90° C. are contemplated, with nucleation temperatures in the range of from 35° to 70° C. being preferred.

A grain growth step, Step (2), follows Step (1). During Step (2) the grain nuclei are grown until tabular grains having {100} major faces of a desired average equivalent circular diameter (ECD) are obtained. Whereas the objective of Step (1) is to form a grain population having the desired incorporated crystal structure irregularities, the objective of Step (2) is to deposit additional silver halide onto (grow) the existing grain population while avoiding or minimizing the formation of additional grains. If additional grains are formed during the growth step, the polydispersity of the emulsion is increased and, unless conditions in the reaction vessel are maintained as described above for the nucleation step, the additional grain population formed in the growth step will not have the desired tabular grain properties described herein for use in the invention.

In its simplest form the process of preparing the desired emulsions can be performed as a single jet precipitation without interrupting silver ion introduction from start to finish, modified by providing a second, iodide jet for the delayed introduction of iodide—i.e., all chloride and/or bromide ions are in the dispersing medium at the outset of precipitation. As is generally recognized by those skilled in the art a spontaneous transition from grain formation to grain growth occurs even with an invariant rate of silver ion introduction, since the increasing size of the grain nuclei increases the rate at which they can accept silver and halide ion from the dispersing medium until a point is reached at which they are accepting silver and halide ions at a sufficiently rapid rate that no new grains can form. Although manipulatively simple, the modified single jet precipitation procedure limits halide content and profiles and generally results in more polydisperse grain populations. It is preferred to employ a balanced double jet precipitation technique in which silver ions and halide ions are concurrently introduced into the dispersing medium. If iodide ion is introduced using a single halide jet, the chloride in the dispersing medium can be relied upon at the outset of nucleation, so that by delaying in turning on the halide jet the appropriate delay in iodide introduction can be effected. Alternatively, a separate iodide jet can be provided.

It is specifically sought to prepare the high chloride {100} tabular grain emulsions with the most geometrically uniform grain populations attainable, since this allows a higher percentage of the total grain population to be optimally sensitized and otherwise optimally prepared for photographic use. Further, it is usually more convenient to blend relatively monodisperse emulsions to obtain aim sensitometric profiles than to precipitate a single polydisperse emulsion that conforms to an aim profile.

One technique for increasing grain monodispersity is to interrupt silver and halide salt introductions at the earliest convenient time after a stable population of grain nuclei have been formed. The emulsion is held within the temperature ranges described above for Step (1) for a period sufficient to allow reduction in grain dispersity. A holding period can range from a minute to several hours, with typical holding periods ranging from 5 minutes to an hour. During the holding period relatively smaller grain nuclei are Ostwald ripened onto surviving, relatively larger grain nuclei, and the overall result is a reduction in grain dispersity.

If desired, the rate of ripening can be increased by the presence of a ripening agent in the emulsion during the holding period. A conventional simple approach to accelerating ripening is to increase the halide ion concentration in the dispersing medium. This creates complexes of silver ions with plural halide ions that accelerate ripening. When this approach is employed, it is preferred to increase the chloride ion concentration in the dispersing medium. That is, it is preferred to lower the pCl of the dispersing medium into a range in which increased silver chloride solubility is observed. Alternatively, ripening can be accelerated and the percentage of total grain projected area accounted for by {100} tabular grains can be increased by employing conventional ripening agents. Preferred ripening agents are sulfur containing ripening agents, such as thioethers and thiocyanates. Typical thiocyanate ripening agents are disclosed by Nietz et al U.S. Pat. No. 2,222,264, Lowe et al U.S. Pat. No. 2,448,534 and Illingsworth U.S. Pat. No. 3,320,069, the disclosures of which are here incorporated by reference. Typical thioether ripening agents are disclosed by McBride U.S. Pat. No. 3,271,157, Jones U.S. Pat. No. 3,574,628 and Rosencrantz et al U.S. Pat. No. 3,737,313, the disclosures of which are here incorporated by reference. More recently crown thioethers have been suggested for use as ripening agents. Ripening agents containing a primary or secondary amino moiety, such as imidazole, glycine or a substituted derivative, are also effective. Sodium sulfite has also been demonstrated to be effective in increasing the percentage of total grain projected area accounted by the {100} tabular grains.

Once the desired population of grain nuclei have been formed, the introduction of silver and, preferably, halide salts can be reinstituted. In most instances delayed iodide addition will be commenced prior to the precipitation interruption and hold period described. Hence generally the interruption and hold occur at the end of Step (1) and before commencing Step (2). However, in those instances in which a relatively high proportion of the total silver is introduced prior to iodide ion introduction, it is possible for the interruption and hold to occur before any iodide has been introduced into the dispersing medium and hence the interruption and hold are wholly contained within Step (1).

Grain growth in Step (2) can proceed according to any convenient conventional precipitation technique for the precipitation of silver halide grains bounded by {100} grain faces. Whereas iodide and chloride ions are required to be incorporated into the grains during Step (1) and are therefore present in the completed grains, any halide or combination of halides known to form a cubic crystal lattice structure can be employed during the growth step. Neither iodide nor chloride ions need be incorporated in the grains during the growth step, since the irregular grain nuclei faces that result in tabular grain growth, once introduced, persist during subsequent grain growth independently of the halide being precipitated, provided the halide or halide combination is one that forms a cubic crystal lattice. This excludes only iodide levels above 13 mole percent (preferably 6 mole percent) in precipitating silver iodochloride, levels of iodide above 40 mole percent (preferably 30 mole percent) in precipitating silver iodobromide, and proportionally intermediate levels of iodide in precipitating silver iodohalides containing bromide and chloride. When silver bromide or silver iodobromide is being deposited during the growth step, it is preferred to maintain a pBr within the dispersing medium in the range of from 1.0 to 4.2, preferably 1.6 to 3.4. When silver chloride, silver iodochloride, silver bromochloride or silver iodobromochloride is being deposited during the growth step, it is preferred to maintain the pCl within the dispersing medium within the ranges noted above in describing Step (1).

It has been observed that bromide additions during grain growth in the range of from 0.05 to 15 mole percent, preferably from 1 to 10 mole percent, based on silver, produce relatively thinner {100} tabular grains than can be realized under the same conditions of precipitation in the absence of bromide ion. Similarly, it has been observed that iodide additions during the growth step in the range of from 0.001 to <1 mole percent, based on silver, produce relatively thinner {100} tabular grains than can be realized under the same conditions of precipitation in the absence of iodide ion.

During Step (2) both silver and halide salts are preferably introduced into the dispersing medium. In other words, double jet precipitation is contemplated, with added iodide salt, if any, being introduced with the remaining halide salt or through an independent jet. The rate at which silver and halide salts are introduced is controlled to avoid renucleation—that is, the formation of a new grain population. Addition rate control to avoid renucleation is generally well known in the art, as illustrated by Wilgus German OLS No. 2,107,118, Irie U.S. Pat. No. 3,650,757, Kurz U.S. Pat. No. 3,672,900, Saito U.S. Pat. No. 4,242,445, Teitschied et al European Patent Application 80102242, and Wey "Growth Mechanism of AgBr Crystals in Gelatin Solution", *Photographic Science and Engineering,* Vol. 21, No. 1, Jan./Feb. 1977, p. 14, et seq.

In the simplest form of the grain preparation the nucleation and growth stages—e.g., Steps (1) and (2) of grain precipitation occur in the same reaction vessel. It is, however, as noted above grain precipitation can be interrupted, typically and most conveniently at the conclusion of Step (1). Further, two separate reaction vessels can be substituted for the single reaction vessel described above. Step (1) can be performed in an upstream reaction vessel (herein also termed a nucleation reaction vessel) and the dispersed grain nuclei can be transferred to a downstream reaction vessel in which Step (2) of grain precipitation occurs (herein also termed a growth reaction vessel). In one arrangement of this type an enclosed nucleation vessel can be employed to receive and mix reactants upstream of the growth reaction vessel, as illustrated by Posse et al U.S. Pat. No. 3,790,386, Forster et al U.S. Pat. No. 3,897,935, Finnicum et al U.S. Pat. No. 4,147,551, and Verhille et al U.S. Pat. No. 4,171,224, here incorporated by reference. In these arrangements the contents of the growth reaction vessel are recirculated to the nucleation reaction vessel.

It is herein contemplated that various parameters important to the control of grain formation and growth, such as pH, pAg, ripening, temperature, and residence time, can be independently controlled in the separate nucleation and growth reaction vessels. To allow grain nucleation to be entirely independent of grain growth occurring in the growth reaction vessel down stream of the nucleation reaction vessel, no portion of the contents of the growth reaction vessel should be recirculated to the nucleation reaction vessel. Preferred arrangements that separate grain nucleation from the contents of the growth reaction vessel are disclosed by Mignot U.S. Pat. No. 4,334,012 (which also discloses the useful feature of ultrafiltration during grain growth), Urabe U.S. Pat. No. 4,879,208 and published European Patent Applications 326,852, 326,853, 355,535 and 370,116, Ichizo published European Patent Application 0 368 275, Urabe et al published European Patent Application 0 374 954, and Onishi et al published Japanese Patent Application (Kokai) 172,817-A (1990).

It has been discovered quite unexpectedly that in addition to all of the advantageous high chloride {100} tabular grain emulsion features described by House et al unexpected increases in the percentage of total grain projected area accounted by high chloride {100} tabular grains can be realized. Further, when iodide introduction is delayed until from 0.01 to 5.0 percent of total silver has been introduced during Step (1), the high chloride {100} tabular grains can account for greater than 95 percent of total grain projected area. In specifically preferred emulsions satisfying the requirements of the invention the high chloride {100} tabular grains account for greater than 97 percent of total grain projected area. In optimized emulsions according to this invention the high chloride {100} tabular grains account for substantially all (>99%, based on projected area) of the grain population.

What is further surprising is that the increased high chloride {100} tabular grain projected areas can be achieved while still retaining the low tabular grain thicknesses and thickness dependent features (e.g., average aspect ratio and tabularity) disclosed by House et al. Absent the observations herein reported it would be assumed that delayed iodide introduction would simply translate into a relatively thicker and less attractive high chloride {100} tabular grain population.

Since by definition a grain must have an aspect ratio of at least 2 to be considered tabular, the average aspect ratio of the high chloride {100} tabular grains can only approach 2 as a lower limit. In fact, the tabular grain emulsions of this invention typically exhibit average aspect ratios of 5 or more, with average aspect ratios greater than 8 being preferred. That is, preferred emulsions preparedly the processes of the invention are high aspect ratio tabular grain emulsions. In specifically preferred emulsions, average aspect ratios of the tabular grain population are at least 12 and optimally at least 20. Typically the average aspect ratio of the tabular grain population ranges up to 50, but higher average aspect ratios of 100, 200 or more can be realized. Emulsions in which the average aspect ratio approaches the minimum average aspect ratio limit of 2 still provide a surface to volume ratio that is 200 percent that of cubic grains.

The tabular grain population can exhibit any grain thickness that is compatible with the average aspect ratios noted hereinbefore. However, particularly when the selected tabular grain population exhibits a high average aspect ratio, it is preferred to additionally limit the grains included in the selected tabular grain population to those that exhibit a thickness of less than 0.3 μm and, optimally, less than 0.2 μm. It is appreciated that the aspect ratio of a tabular grain can be limited either by limiting its equivalent circular diameter or increasing its thickness. Thus, when the average aspect ratio of the tabular grain population is in the range of from 2 to 8, the tabular grains accounting for at least 50 percent of total grain projected area can also each exhibit a grain thickness of less than 0.3 μm or less than 0.2 μm. Nevertheless, in the aspect ratio range of from 2 to 8 particularly, there are specific benefits that can be gained by greater tabular grain thicknesses. For example, in constructing a blue recording emulsion layer of maximum achievable speed it is specifically contemplated that tabular grain thicknesses that are on average 1 μm or even larger can be used. This is because the eye is least sensitive to the blue record and hence higher levels of image granularity (noise) can be tolerated without objection. There is an additional incentive for employing larger grains in a blue record since it is sometimes difficult to match in the blue record the highest speeds attainable in the green and red record. A source of this difficulty resides in the blue photon deficiency of sunlight. While sunlight on an energy basis exhibits equal parts of blue, green and red light, at shorter wavelengths the photons have higher energy. Hence on a photon distribution basis daylight is slightly blue deficient.

The tabular grain population preferably exhibits major face edge length ratios of less than 5 and optimally less than 2. The nearer the major face edge length ratios approach 1 (i.e., equal edge lengths) the lower is the probability of a significant rod population being present in the emulsion. Further, it is believed that tabular grains with lower edge ratios are less susceptible to pressure desensitization.

In one specifically preferred form of the invention the tabular grain population accounting for at least 50 percent of total grain projected area is provided by tabular grains also exhibiting 0.2 μm thicknesses. In other words, the emulsions are in this instance thin tabular grain emulsions.

A significant feature of the emulsion preparation technique described herein is that it can be used to provide ultrathin tabular grain emulsions satisfying the requirements needed for use in the color photographic elements of the invention. Ultrathin tabular grain emulsions are those in which the selected tabular grain population is made up of tabular grains having thicknesses of less than 0.07 μm. Prior to discovery of the present technique, the only ultrathin tabular grain emulsions known in the art that had a halide content exhibiting a cubic crystal lattice structure contained tabular grains bounded by {111} major faces. Thus, it was thought essential to form tabular grains by the mechanism of parallel twin plane incorporation to achieve ultrathin dimensions. Emulsions prepared as described herein can have a tabular grain population with a mean thickness down to 0.02 μm and even 0.01 μm. Ultrathin tabular grains have extremely high surface to volume ratios. This permits ultrathin grains to be photographically processed at accelerated rates. Further, when spectrally sensitized, ultrathin tabular grains exhibit very high ratios of speed in the spectral region of sensitization as compared to the spectral region of native sensitivity. For example, the ultrathin tabular grain emulsions described herein can have entirely negligible levels of blue sensitivity, and are therefore capable of providing a green or red record in a color photographic element that exhibits minimal blue contamination even when located to receive blue light.

The characteristic of tabular grain emulsions that sets them apart from other emulsions is the ratio of grain ECD to thickness (t). This relationship has been expressed quantitatively in terms of aspect ratio. Another quantification that is believed to assess more accurately the importance of tabular grain thickness is tabularity:

$$T=ECD/t^2=AR/t$$

where

T is tabularity;

AR is aspect ratio;

ECD is equivalent circular diameter in micrometers (μm); and t is grain thickness in micrometers.

The selected tabular grain population accounting for 50 percent of total grain projected area as described herein preferably exhibits a tabularity of greater than 25 and most preferably greater than 100. Since the tabular grain population can be ultrathin, it is apparent that extremely high tabularities, ranging to 1000 and above are within the contemplation of our invention.

The tabular grain population can exhibit an average ECD of any photographically useful magnitude. For photographic utility average ECD's of less than 10 μm are contemplated, although average ECD's of the tabular grain emulsions used in this invention rarely exceed 6 μm. Within ultrathin tabular grain emulsions satisfying the requirements of the invention it is possible to provide intermediate aspect ratios with ECD's of the tabular grain population of 0.10 μm and less. As is generally understood by those skilled in the art, emulsions with selected tabular grain populations having higher ECD's are advantageous for achieving relatively high levels of photographic sensitivity while selected tabular grain populations with lower ECD's are advantageous in achieving low levels of granularity.

EXAMPLES

The invention can be better appreciated by reference to the following specific embodiments.

Emulsion A. (Invention)

This emulsion demonstrates that high chloride {100} tabular grain emulsions can be precipitated when iodide introduction is delayed until after grain nucleation has occurred. Delaying iodide introduction was observed to increase the proportion of total grain projected area accounted for by high chloride {100} tabular grains.

A 12 L reactor charged with 2.9 L of distilled water containing 2 g of NaCl, and 130 g of oxidized gelatin was adjusted to pH 5.7 at 35° C. The kettle was stirred rigorously throughout the precipitation process. To this solution were added simultaneously 4M $AgNO_3$ and 4M NaCl at a rate of 15 mL/min each for 1.6 min, consuming 1.6 percent of the total silver used for precipitation. A solution containing 5.7 L of distilled water, 190 g of 0.012M KI solution, and 1.5 g of NaCl were then added. The solution was allowed to sit for 5 minutes. After the hold, the mixture temperature was ramped from 35° C. to 65° C. in 20 minutes and during the same time 4M $AgNO_3$ and 4M NaCl solutions were added at 10 mL/min each, with pCl ramped down from 2.39 to 2.24. The temperature was further ramped from 50° C. to 65° C. in 20 minutes, during which solutions were added in a linearly accelerated rate from 10 to 15 mL/min, with pCl linearly decreased from 2.2 to 1.82. After the ramp, the medium was allowed to sit at 65° C. for 20 minutes. After the hold, addition of the $AgNO_3$ and NaCl solutions was resumed at linearly accelerated rates from 10 to 28.7 mL/min in 45 minutes. The pCl of the emulsion was held at 1.82 during the final growth period. Then the reactor was allowed to sit at 65° C. for another 30 minutes. After the hold, a 200 cc solution containing 4.96 grams of KI was added and the emulsion was allowed to sit for 10 minutes. Final growth was completed by adding 4M $AgNO_3$ and NaCl solutions at 10 cc/min for 13 minutes with pCl controlled at 1.82.

In the resulting high chloride {100} tabular grain emulsion tabular grains accounted for 99.2 percent of the total grain projected area. The emulsion contained 0.545 mole percent iodide, based on silver. A total of 5.9 moles of silver were precipitated. The emulsion exhibited a mean grain ECD of 2.2 μm and a mean grain thickness of 0.15 μm. FIG. 1 is a scanning electron micrograph (SEM) of the resulting emulsion.

Emulsion B. (Comparative Emulsion)

This emulsion demonstrates significant increase of singly twinned crystals in emulsions made with iodide present in nucleation.

A 12 L reactor charged with 2.9 L of distilled water containing 2 g of NaCl, 190 g of 0.012M KI solution and 130 g of oxidized (<0.3 μmole methionine per gram) gelatin was adjusted to pH 5.7 at 35° C. The kettle was stirred rigorously. To this solution were added simultaneously 4M of $AgNO_3$ and 4M of NaCl at a rate of 10 mL/min each for 15 seconds, consuming 1.6 percent of the total silver used for precipitation.

A solution containing 5.7 L of distilled water and 1.5 g of NaCl was then added. The solution was allowed to sit for 5 minutes. After the hold the mixture temperature was raped from 35° C. to 50° C. in 20 minutes and during the same time 4M $AgNO_3$ and 4M NaCl solutions were added at 10 mL/min each, with pCl ramped down from 2.39 to 2.24. The temperature was further ramped from 50° C. to 65° C. in 20 minutes, during which solutions were added in a linearly accelerated rate from 10 to 15.0 mL/min, with pCl linearly decreased from 2.2 to 1.82. After the ramp, the medium was allowed to sit at 65° C. for 20 minutes. After the hold, addition of the $AgNO_3$ and NaCl solutions was resumed at linearly accelerated rates from 10 to 28.7 mL/min in 45 minutes. The pCl of the emulsion was held at 1.82 during the final growth period. Then the reactor was allowed to sit at 65° C. for another 30 minutes. After the hold, a 200 cc solution containing 4.96 gram of KI was added, and the emulsion was allowed to sit for 10 minutes. Final growth was completed by adding the 4M $AgNO_3$ and NaCl solutions at 10 cc/min for 13 minutes with pCl controlled at 1.82.

The resulting tabular grain emulsion contained high chloride {100} tabular grain grains in a mixed grain population, including many single twinned, nontabular grains. The emulsion exhibited a mean grain ECD of 3.5 μm and a mean grain thickness of about 0.22 μm. FIG. 2 is an SCM of the resulting emulsion. From FIG. 2 it is apparent that a large percentage of total grain projected area was accounted for by grains other than {100} tabular grains.

Emulsion C. (Invention)

This emulsion further demonstrates that high chloride {100} tabular grains can be precipitated with a high proportion of total grain projected area by accounted by {100} tabular grains when iodide addition is delayed until after grain nucleation has occurred.

A 12 L reactor charged with 2.9 L of distilled water containing 2 g of NaCl and 130 gram of oxidized gelatin was adjusted to pH 5.7 at 35° C. The kettle was stirred rigorously throughout the precipitation process. To this solution were added simultaneously 0.5M $AgNO_3$ and 0.5M NaCl solutions at a rate of 25 mL/min each for 14.4 sec, consuming 0.06 percent of the total silver used for precipitation. The pCl was maintained at 2.39 during nucleation. A solution containing 5.7 L of distilled water, 16 g of 0.012 KI solution, and 1.5 g of NaCl was then added. The solution was allowed to sit for 5 minutes. After the hold, the mixture temperature was ramped from 35° C. to 50° C. in 20 minutes and during the same time 2M $AgNO_3$ and 2M NaCl solutions were added at 15 mL/min each, with pCl ramped down from 2.39 to 2.24. The temperature was further ramped to 75° C. in 20 minutes, during which solutions were added in a linearly accelerated rates of from 15 to 25.0 mL/min, with pCl linearly decreased from 2.24 to 1.75. After the ramp, the medium was allowed to sit at 75° C. for 15 minutes. After the hold, 4 molar solutions of $AgNO_3$ and NaCl were each added at linearly accelerated rates from 12.5 to 26 mL/min in 45 minutes. The pCl of the emulsion was held at 1.75 during the final growth period. Then the reactor was allowed to sit at 75° C. for another 30 minutes.

In the resulting high chloride {100} tabular grain emulsion tabular grains accounted for 95.9 percent of the total grain projected area. The emulsion contained 0.00384 mole percent iodide, based on silver. A total of 5.0 moles of silver were precipitated. The emulsion exhibited a mean grain ECD of 2.94 μm and a mean grain thickness of 0.25 μm.

Emulsion D (Invention)

Emulsion D was prepared similarly as Emulsion C, except that 1 Molar solutions were used in nucleation and 30 g of 0.012M KI solution were added instead of 16 g. Nucleation silver was 0.12% of total silver.

In the resulting high chloride {100} tabular grain emulsion tabular grains accounted for 98 percent of the total grain projected area. The emulsion contained 0.0072 mole percent iodide, based on silver. A total of 5.0 moles of silver were precipitated. The emulsion exhibited a mean grain ECD of 2.1 μm and a mean grain thickness of 0.18 μm. FIG. 3 is an SEM of the resulting emulsion.

Emulsion E. (Invention)

This emulsion further demonstrates that high chloride {100} tabular grains can be precipitated with iodide introduction delayed until after grain nucleation has occurred. The nucleation was carried out at high flow rates using 1 molar silver and chloride ion containing solution.

A 12 L reactor charged with 3.1 L of distilled water containing 2 g of NaCl and 130 gram of oxidized gelatin was adjusted to pH 5.7 at 35° C. The kettle was stirred rigorously throughout the precipitation process. To this solution were added simultaneously 1M $AgNO_3$ and 1M NaCl solutions each at a rate of 50 mL/min each for 1.6 min, consuming 1.3 percent of the total silver used for precipitation. The pCl was maintained at 2.39 during nucleation.

A solution containing 5.8 L of distilled water, 190 g of 0.12M KI solution and 1.5 g of NaCl was then added. The solution was allowed to sit for 5 minutes. After the hold, the mixture temperature was ramped from 35° C. to 50° C. in 20 minutes and during the same time 4M $AgNO_3$ an 4M NaCl solutions were added at 10 mL/min each, with pCl ramped down from 2.39 to 2.24. The temperature was further ramped from 50° C. to 65° C. in 20 minutes, during which period the $AgNO_3$ and NaCl solutions were added at linearly accelerated rates from 10 to 15.0 mL/min, with pCl linearly decreased from 2.2 to 1.82. After the ramp, the medium was allowed to sit at 65° C. for 20 minutes. After the hold, addition of the $AgNO_3$ and NaCl solutions was resumed at linearly accelerated rates from 10 to 28.7 mL/min in 45 minutes. The pCl of the emulsion was held at 1.82 during the final growth period. Then the reactor was allowed to sit at 65° C. for another 30 minutes.

After the hold, a 200 cc solution containing 4.96 grams of KI was added, and the emulsion was allowed to sit for 10 minutes. Final growth was completed by adding 4M $AgNO_3$ and NaCl solutions at 10 cc/min for 13 minutes with pCl controlled at 1.82.

In the resulting high chloride {100} tabular grain emulsion tabular grains accounted for 98.5 percent of the total grain projected area. A total of 5.74 moles of silver were precipitated. The emulsion exhibited a mean grain ECD of 2.1 μm and a mean grain thickness of 0.16 μm.

Emulsion F. (Invention)

This emulsion further demonstrates that high chloride {100} tabular grain emulsions can be precipitated with iodide introduction delayed until after grain nucleation has occurred. In this emulsion preparation the tabular grains were grown at a higher temperature and a high nucleation flow rate.

A 12 L reactor charged with 2.9 L of distilled water containing 2 g of NaCl and 130 gram of oxidized gelatin was adjusted to pH 5.7 at 35° C. The kettle was stirred rigorously throughout the precipitation process. To this solution were added simultaneously 1M $AgNO_3$ and 1M NaCl solutions each at a rate of 52 mL/min for 1.6 minutes, consuming 1.55 percent of the total silver used for precipitation. The pCl was maintained at 2.39 during nucleation.

A solution containing 5.7 L of distilled water, 190 g of a 0.012M KI solution, and 1.5 g of NaCl was then added. The solution was allowed to sit for 5 minutes. After the hold, the mixture temperature was ramped from 35° C. to 50° C. in 20 minutes, and during the same time period 4M $AgNO_3$ and 4M NaCl solutions were added at 10 mL/min, with pCl ramped down from 2.39 to 2.24. The temperature was further ramped from 50° C. to 70° C. in 20 minutes, during which time solutions were added in a linearly decreased from 2.24 to 1178. After the ramp, the medium was allowed to sit at 70° C. for 15 minutes. After the hold, addition of the 1M $AgNO_3$ and 1M NaCl solutions was resumed each at linearly accelerated rates from 10 to 28.2 mL/min in 45.6 minutes. The pCl of the emulsion was held at 1.78 during the final growth period. Then the reactor was allowed to sit at 70° C. for another 30 minutes.

In the resulting high chloride {100} tabular grain emulsion tabular grains accounted for 98.7 percent of the total grain projected area. The emulsion contained 0.042 mole percent iodide, based on total silver. A total of 5.37 moles of silver were precipitated. The emulsion exhibited a mean grain ECD of 2.5 μm and a mean grain thickness of 0.16 μm.

Emulsion G. (Invention)

This emulsion further demonstrates that a high chloride {100} tabular grain emulsion can be precipitated with iodide introduction delayed until grain nucleation. In the preparation of this emulsion iodide introduction was delayed until after 21.8 percent of total silver had been precipitated.

A 12 L reactor charged with 3.1 L of distilled water containing 2 g of NaCl, and 130 grams of oxidized gelatin was adjusted to pH 5.7 at 35° C. The kettle was stirred rigorously throughout the precipitation process. To this solution were added simultaneously 1M $AgNO_3$ and 1M NaCl solutions each at a rate of 50 mL/min each for 1.6 minutes, consuming 21.8 percent of the total silver used for precipitation. The pCl was maintained at 2.39 during nucleation.

A solution containing 5.8 L of distilled water, 190 g of 0.012 KI solution, and 1.5 g of NaCl was then added. The solution was allowed to sit for 5 minutes. After the hold, the mixture temperature was ramped from 35° C. to 65° C. in 30 minutes and during the same time 1M $NO_3$ and 1M NaCl solutions were added at 10 mL/min each, with pCl ramped down from 2.39 to 1.82. After the ramp, the medium was allowed to sit at 65° C. for 45 minutes.

In the resulting high chloride {100} tabular grain emulsion tabular grains accounted for 97.7 percent of the total grain projected area. A total of 0.38 mole of silver was precipitated. The emulsion exhibited a mean grain ECD of 1.04 μm and a mean grain thickness of 0.07 μm.

Emulsion H. (Invention)

This emulsion demonstrates that high aspect ratio grains can be obtained when low mixer speeds are used from the nucleation to the end of the precipitation.

An 18 L reactor charged with 4.5 L of distilled water containing 3 g of NaCl and 195 g of oxidized gelatin was adjusted to pH 5.7 at 35° C. The kettle was stirred at 1500 rpm throughout the precipitation. To this solution were added simultaneously 4M $AgNO_3$ and 4M NaCl at a rate of 22.5 mL/min each for 77 sec. A solution containing 9 L of distilled water, 300 mL of a solution of 0.012M of KI and 2.25 g of NaCl was then added to the kettle. The mixture was allowed to sit for 8 minutes while being stirred. Growth was then carried out with 4M $AgNO_3$ and 4M NaCl. During growth silver and halide salt solutions were added simultaneously at a rate of 12 mL/min each for 2 min, in order to raise pCl to 2.4. Then the flow rates were ramped up to 15 mL/min each in 38 min, while the temperature was ramped to 65° C. Growth was then temporarily interrupted for 20 min to allow ripening of the fine grains. After the hold, growth resumed for 45 min, and the flow rates were ramped from 15 mL/min to 39 mL/min each. After the ramp, the medium was allowed to sit at 65° C. for 20 minutes.

In the resulting high chloride {100} tabular grain emulsion tabular grains accounted for approximately 80 percent of the total grain projected area. The emulsion exhibited a mean grain ECD of 3.0 μm and a mean grain thickness of 0.14 μm.

The invention has been described in detail with particular reference to preferred embodiments thereof, but it will be understood that variations and modifications can be effected within the spirit and scope of the invention.

What is claimed is:

1. A process of precipitating a photographic emulsion containing a dispersing medium and grains comprised of iodide and at least 50 mole percent chloride with tabular grains having {100} major faces accounting for greater than 50 percent of total grain projected area, comprised of the steps of (1) separately introducing soluble silver and halide salts into a reaction vessel containing at least a portion of the dispersing medium so that nucleation occurs while the dispersing medium is maintained at a pCl in the range of from 0.5 to 3.5 and (2) following step (1) completing grain growth under conditions that maintain the {100} major faces of the tabular grains, wherein, (3) precipitation is conducted in the absence of an aromatic grain growth stabilizer containing a nitrogen atom having a resonance stabilized $\pi$ electron pair and (4) during step (1) iodide ion is withheld from the reaction vessel until after the soluble silver and halide salts have reacted in the reaction vessel to form grain nuclei and thereafter iodide ion is introduced into the dispersing medium Within the reaction vessel after at least 0.01 percent and before 3 percent of total silver forming the grains has been introduced.

2. A process according to claim 1 wherein iodide ion is introduced into the dispersing medium before 1.5 percent of total silver forming the grains has been introduced.

3. A process according to claim 1 wherein the halides introduced during step (1) consist essentially of chloride and iodide.

* * * * *